United States Patent [19]

Nash

[11] Patent Number: 4,821,347

[45] Date of Patent: Apr. 18, 1989

[54] EXTENSIBLE SHAMPOO BOWL DESIGNED FOR INDIVIDUAL CONFINED TO A WHEELCHAIR

[76] Inventor: Lavonne Nash, 5936 Market St., Lot 13, Wilmington, N.C. 28405

[21] Appl. No.: 149,006

[22] Filed: Jan. 27, 1988

[51] Int. Cl.[4] ..... A45D 19/04

[52] U.S. Cl. ..... 4/516; 4/519

[58] Field of Search ..... 4/515–519, 4/523

[56] References Cited

U.S. PATENT DOCUMENTS

| | | | |
|---|---|---|---|
| 2,682,058 | 6/1954 | Wolfe | 4/516 |
| 2,772,721 | 12/1956 | Saunders | 4/578 X |
| 3,192,537 | 7/1965 | Coffman et al. | 4/516 |
| 4,660,233 | 4/1987 | Beaver | 4/519 X |

FOREIGN PATENT DOCUMENTS

| | | | |
|---|---|---|---|
| 1457399 | 4/1969 | Fed. Rep. of Germany | 4/578 |

*Primary Examiner*—Charles E. Phillips

*Attorney, Agent, or Firm*—Rhodes, Coats & Bennett

[57] ABSTRACT

The present invention discloses an extensible shampoo bowl that is particularly designed to be used in shampooing the hair of an individual confined or seated in a wheelchair. Structurely, the present invention entails a cabinet structure with an extensible shampoo bowl mounted thereto. In particular, by utilizing a scissor-type linkage between the cabinet and shampoo bowl, the shampoo bowl can be raised adjacent the wheelchair.

6 Claims, 4 Drawing Sheets

EXTENSIBLE SHAMPOO BOWL DESIGNED FOR INDIVIDUAL CONFINED TO A WHEELCHAIR

FIELD OF THE INVENTION

The present invention relates to shampoo bowls and cabinet structures, therefore, and more presently to shampoo bowls and cabinet structures designed for use by the handicapped.

BACKGROUND OF THE INVENTION

For many years, beauticians and nurses have struggled with the problem of shampooing a persons hair that is confined to a wheelchair. The real problem is maneuvering and positioning that individual close enough to the shampoo bowl in order that his or her head can extend into the open bowl area while at the same time the individual is confined within the wheelchair.

Typically shampoo bowls are mounted within a cabinet structure or sometimes they are simply integrally constructed with a shampoo lounge chair. The problem, again, is maneuvering the wheelchair to where the individual therein can extend his or her neck over the scoop area generally formed on the side of a conventional shampoo bowl. It is often very difficult to accomplish this because of the presence of the wheels of the wheelchair. In some wheelchair designs, the rear wheels reject 12 inches or more from the back side of the wheelchair itself. Consequently, it is impossible to back the wheelchair up to a shampoo bowl in such a position.

Consequently, in most cases, the beautician or nurse will have to seek assistance to remove the person from the wheelchair and then reseat the person in a conventional chair for shampooing. Obviously, this can be time consuming, troublesome, and can be very discomforting to the individual confined within the wheelchair.

Therefore, there has been and continues to be a need for a shampoo bowl that is designed to meet the needs of handicapped individuals, especially individuals confined to a wheelchair.

SUMMARY AND OBJECTS OF THE INVENTION

The present invention presents a shampoo bowl that is specifically designed to meet the needs of handicapped individuals and particularly those confined to a wheelchair. The present invention entails a cabinet structure that has an extensible shampoo bowl mounted about the top thereof. By utilizing a pair of scissor-type linkages, the shampoo bowl may be moved upwardly and outwardly from the cabinet. Thereby, it allows itself to extend outwardly to where an individual confined within a wheelchair can be moved directly adjacent the shampoo bowl in order that his or her hair can be shampooed.

It is therefore an object of the present invention to provide a shampoo bowl and an associated cabinet assembly that will permit the shampoo bowl to be extended upwardly and outwardly to reach the head area of an individual confined within a wheelchair in order that individual's hair can be shampooed without being displaced from the chair.

Another object of the present invention is to provide a combination shampoo bowl and cabinet structure wherein the shampoo bowl is extensible from the cabinet structure and particularly designed to be moved upwardly and outwardly from the cabinet.

Still a further object of the present invention resides in the provision of an extensible shampoo bowl and associated cabinet structure of the character referred to above that is provided with dispensers for shampoo and conditioner as well as storage compartments for equipment used by the beautician.

It is also an object of the present invention to provide an extensible shampoo bowl of a character referred to above that is designed to be used in a variety of ways in shampooing handicapped and bedridden patients.

It is an object of the present invention to provide an extensible shampoo bowl of the character referred to above that can adjust to a suitable height adjacent either a bed, wheelchair, or other structure for the purpose of shampooing an individual's hair.

Other objects and advantages of the present invention will become apparent and obvious from a study of the following description and the accompanying drawings which are merely illustrative of such invention.

DETAILED DESCRIPTION OF THE INVENTION

With further reference to the drawings, the extensible shampoo bowl and cabinet structure of the present invention is shown therein and indicated generally by the numeral 10.

Figure 1:
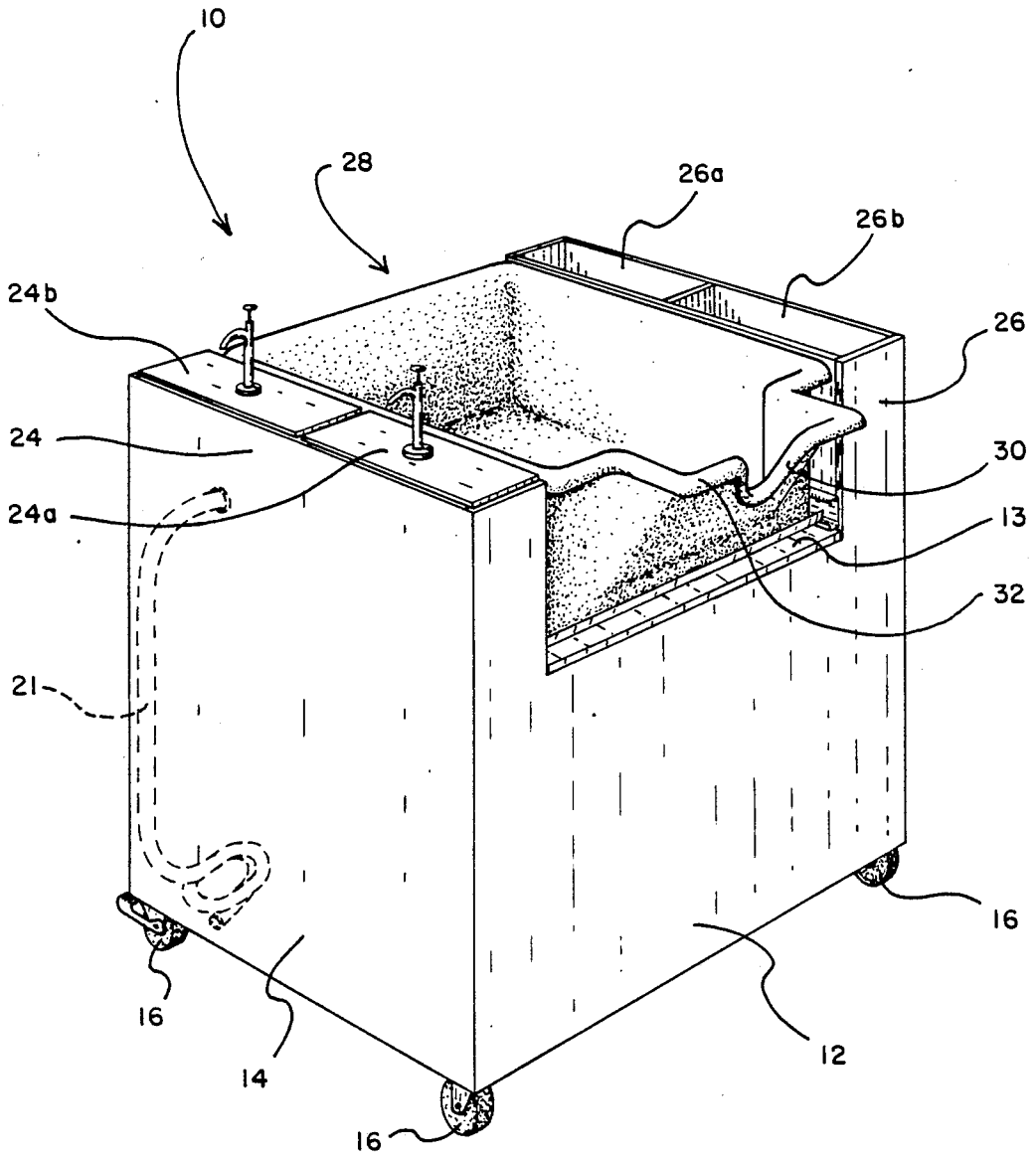
FIG. 1 is a perspective view of the extensible shampoo bowl and associated cabinet of the present invention.
Figure 2:
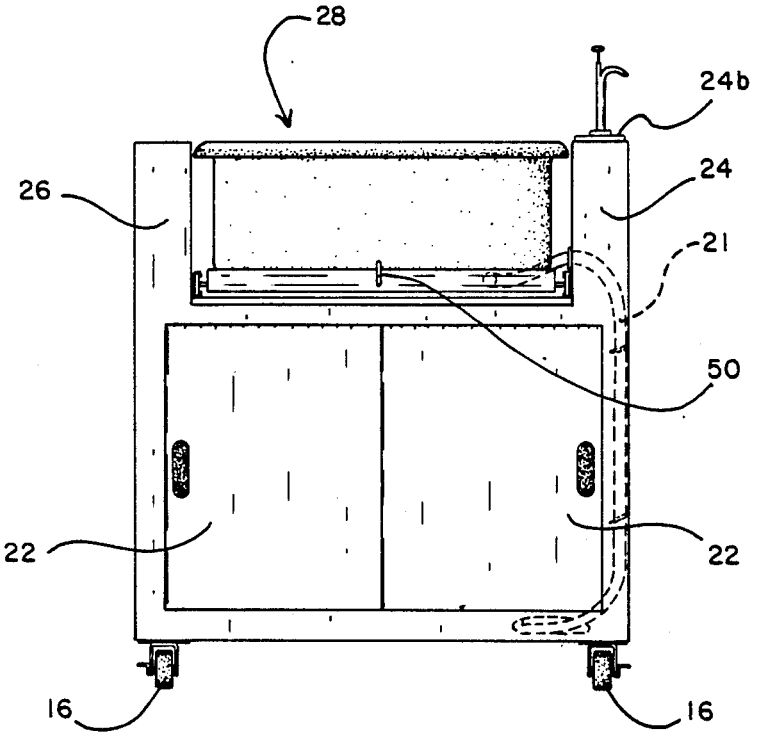
FIG. 2 is a rear elevational view of the extensible shampoo bowl and associated cabinet assembly.
Figure 4:
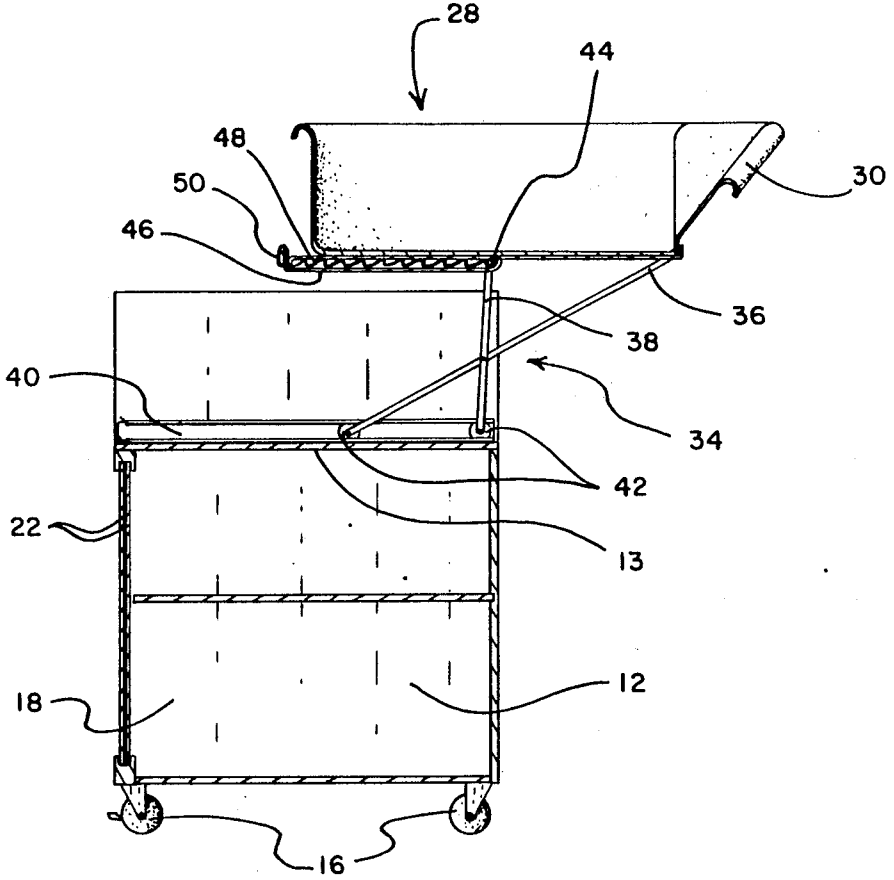
FIG. 4 is a side sectional view of the extensible shampoo bowl and associated cabinet of the present invention with the shampoo bowl being disposed in the extended position where it assumes a position upwardly and outwardly from the supporting cabinet structure.
Figure 3:
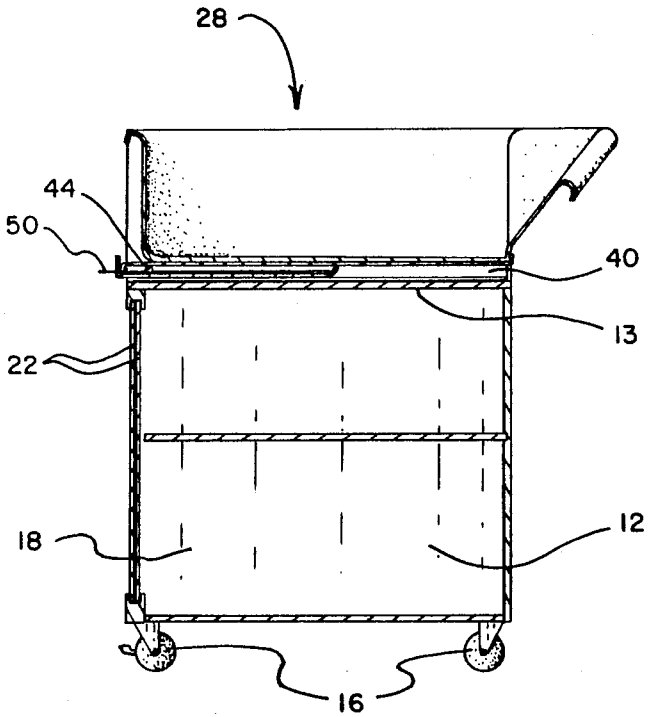
FIG. 3 is a side sectional view of the extensible shampoo bowl and associated cabinet assembly with the shampoo bowl being shown in a lowered position.
Figure 5:
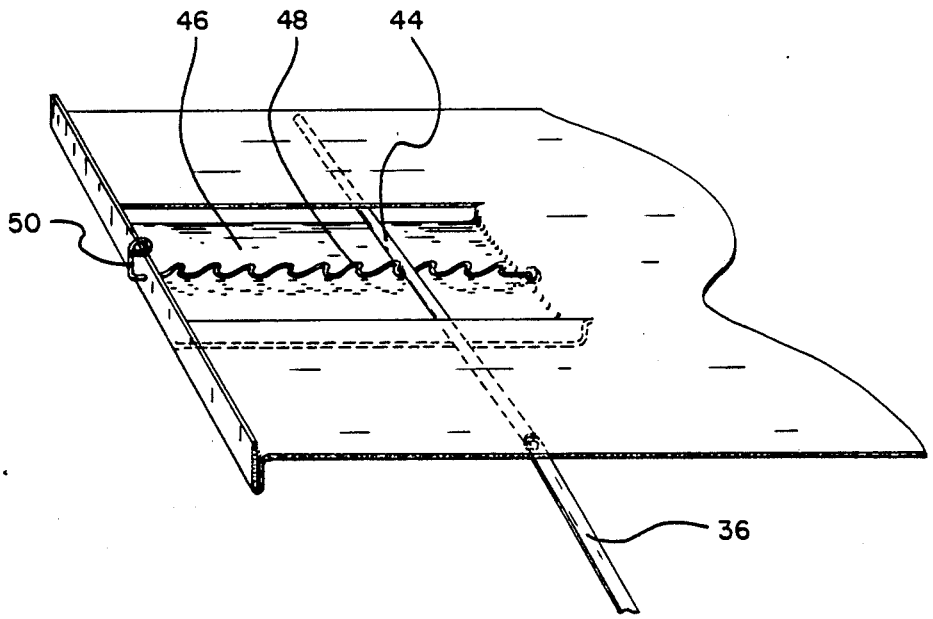
FIG. 5 is a fragmentary perspective view of the locking mechanism used to station the shampoo bowl in an elevated position.

Viewing the cabinet portion of the present invention, it is seen that the same includes front panel 12, two side panels 14 and a top panel 13. A storage area 18 is defined within the cabinet and is seen in FIGS. 3 and 4. The cabinet structure includes an intermediate shelf 20. The cabinet includes a pair of sliding rear doors 22.

In order that the cabinet structure may be mobile, the same is provided with four castor wheels 16. It is noted that at least the rear castor wheels have brakes provided.

Extending upwardly about opposite sides of a cabinet is a pair of shoulder portions 24 and 26 that define an open area therebetween. In the case of this disclosure, shoulder portion 24 serves as a shampoo dispenser and storage compartment **24*a* and a conditioner dispenser and conditioner storage compartment 24*b*. On the opposite side, the other shoulder 26 forms two open top compartments 26*a* and 26*b*** that can be used for storage of a hairdryer, drop cord, or any other equipment that the beautician may desire.

Disposed between the shoulder portions 24 and 26 is a shampoo bowl indicated generally by the numeral 28.

The shampoo bowl is of a conventional type inasmuch as it includes a neck scoop 30 for receiving a person's neck during the shampooing process. In addition, at least the front edge of the shampoo bowl in the area around the neck scoop is provided with a rubber or resilient strip that is particularly important in shampooing handicapped or afflicted patients.

As seen in FIGS. 3 and 4, the shampoo bowl is designed to be moved from a lowermost position, as seen in FIG. 3, to an elevated position, as seen in FIG. 4. In the elevated position it is seen that the shampoo bowl 28 is disposed over top 13 of the cabinet and is disposed outwardly from the cabinet structure itself. Consequently, the extensible shampoo bowl and cabinet structure is provided with mounting means, indicated generally by the numeral 34 for moving the shampoo bowl between the lowermost position as viewed in FIG. 3 and the extended position shown in FIG. 4. Reviewing the mounting means 34 in detail, it is seen that the present invention employs two scissor-type linkages of opposite sides of the bowl. This scissor-type linkage enables the shampoo bowl 28 to be moved between the positions illustrated in FIGS. 3 and 4.

Viewing a single scissors linkage, it is seen that the same includes a pair of links 36 and 38 with the foremost projecting link 36 being somewhat longer than the other link 38. As seen in the drawing, links 36 and 38 are pivotally connected together at an intermediate point. About each side of the shampoo bowl 28 along the top 13 of the cabinet structure, there is provided a track 40. Track 40 serves to receive and confine a pair of wheels 42, each wheel 42 being connected to corresponding ends of links 36 and 38. The forward most projecting link 36 is pivotally connected to the shampoo bowl 28. The other link 38 connects to a crossbar 44 that extends along a guide bar 46 that is connected to the lower portion of the shampoo bowl 28. Overlying crossbar 44 is a rotating locking bar 48, locking bar 48 being of the serrated tooth type. Rotating locking bar 48 can be rotated from a locked position as shown in FIG. 4 to an unlocked position illustrated in FIG. 3. In the locked position, the serrated teeth are turned downwardly and extend into engagement with the crossbar 44. When the locking bar 48 is turned to a position where its teeth extend straight downwardly, the locking bar assumes a locked position as it engages crossbar 44 and prevents the same from moving back and forth along guide bar 46. The rotating locking bar 48 can be turned at least 90° between the locked and unlocked positions by a twist handle 50 extending from the rear end of the locking bar.

Therefore, it is appreciated that the shampoo bowl 28 can be moved from its lowermost position shown in FIG. 3 to its elevated and extended position shown in FIG. 4. To move the shampoo bowl 28 to the extended elevated position, the locking bar 48 is turned to an unlocked position. In this position, the shampoo bowl can be pulled upwardly and at the same time the shoulder links 38 of each scissor-type linkage can be rotated clockwise and upwardly. As the shorter links 38 are moved upwardly, the other link, link 36 and the shampoo bowl can be pulled forwardly. Once the shampoo bowl 28 has reached a selected elevation, the operator can turn the locking bar 48 to its locked position where its teeth will engage the crossbar 44 extending between opposite links 38.

In this position, a person in a wheelchair can be pushed directly adjacent the scoop 30 of the shampoo bowl. Once the rear castor wheels have been locked, the wheelchair can be maneuvered in such a position that the individual therein can simply relax his or her neck muscles and allow the head portion to move into the plane of the shampoo bowl. It is appreciated that the shampoo bowl would extend outwardly a distance at least equal to the distance that the rear wheels of the wheelchair extend back from the seat of the chair. That clearly enables the shampoo bowl 28 to be brought in direct contact with the patient's head.

In addition, the shampoo bowl 28 would be provided with a drain and a flexible drain line leading from the shampoo bowl 28 through a portion, preferrably a corner portion of the cabinet structure. Also, the extensible shampoo bowl and cabinet would be provided with a sprayer or water outlet that would be communicatively connected to a flexible line extending from the cabinet which would be adapted to connect to any conventional water facet.

From the foregoing specification and discussion, it is seen that the present invention entails an extensible shampoo bowl and cabinet assembly that is specifically designed for use by the handicapped and especially those individuals confined in a wheelchair. The extensible shampoo bowl is easy to use and is of a simple and inexpensive design.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An extensible and laterally shiftable shampoo bowl and cabinet assembly adapted for use in conjunction with a person confined to a wheelchair comprising: a movable lower cabinet having an internal storage area and access doors that enable one to gain access to the storage area; the cabinet having a shampoo bowl seat formed about an upper portion thereof and wherein the cabinet includes side shoulder portions that extend upwardly over the shampoo bowl seat so as to define an area therebetween for receiving a shampoo bowl; a mobile shampoo bowl disposed over the bowl seat of the cabinet; mounting means interposed between the shampoo bowl and the cabinet for movably mounting the shampoo bowl for both vertical and lateral movement relative to the cabinet; the mounting means including vertical, extensible means connected to the shampoo bowl for raising and lowering the bowl between a lower position with the shampoo bowl lying adjacent the bowl seat to an upper position with a shampoo bowl spaced upwardly above the bowl seat; the mounting means further including means for moving the shampoo bowl laterally from a position over the cabinet to a lateral extended position where the shampoo bowl assumes an offset position with respect to the cabinet and wherein there is provided a track structure associated with the cabinet and wherein the mounting means is movably contained within the track structure and movable back and forth therein; and wherein the mounting means includes a scissor-type linkage disposed about opposite sides of the shampoo bowl with the scissor-type linkage interconnected between the cabinet and the bowl and including a pair of linkages pivotally connected together about an intermediate point and movable between a closed position where the shampoo bowl overlies the bowl seat to an open expanded position where the bowl assumes a position spaced above the cabinet structure and outwardly to one side thereof.

2. The shampoo bowl and cabinet assembly of claim 1 including locking means for stationing the pair of scissor-type linkages in an extended position for supporting the shampoo bowl in the elevated and at least slightly outward disposition for dispensing such fluids as shampoo and conditioner.

3. The shampoo bowl and cabinet assembly of claim 2 further including dispensing means for dispensing hair care products.

4. An extensible shampoo bowl that is particularly adapted for use by the handicapped and especially wheelchair patients comprising: a frame structure; a shampoo bowl movably mounted to the frame structure; and mounting means for movably mounting shampoo bowl both vertically and horizontally with respect to the frame structure, the mounting means including means for moving the shampoo bowl vertically between a first lowermost position and a second elevated position, and between a first position overlying the frame structure and a second horizontally extended position where the shampoo bowl is disposed in an offset relationship with the frame structure and extends outwardly to one side thereof; and wherein the mounting means comprises a scissors linkage disposed about the opposite sides of the shampoo bowl and interconnected between the frame structure and the shampoo bowl, each scissor linkage including first and second links pivotally connected at intermediate points thereon, wheels rotatively mounted on corresponding ends of each link and confined within a tract supported by the frame structure, and wherein the opposite ends of the links are operatively connected to the shampoo bowl such that each scissor linkage is movable from a collapsed lower position where the respective links thereof extend substantially horizontal to an extended elevated position where the links extend substantially vertical such that the shampoo bowl assumes an elevated position spaced above and outwardly of the frame structure.

5. The extensible shampoo bowl of claim 4 including locking means for securing the scissor linkage in the extended position where the shampoo bowl lies.

6. The extensible shampoo bowl of claim 5 wherein the locking means includes a guide bar secured to the shampoo bowl and a serrated two-type locking bar disposed adjacent thereto and movable between locked and unlocked positions, and wherein a portion of the scissors linkage is mounted adjacent the guide bar and moves there along as the scissor linkage is moved between the collapsed and extended positions and wherein the locking bar may be locked to secure the scissor linkage in a number of positions.

* * * * *